US010743624B1

(12) United States Patent
Hsu

(10) Patent No.: US 10,743,624 B1
(45) Date of Patent: Aug. 18, 2020

(54) BUCKLE ASSEMBLY WITH LOCKING ARRANGEMENT

(71) Applicant: Frank C. Hsu, Chino Hills, CA (US)

(72) Inventor: Frank C. Hsu, Chino Hills, CA (US)

( * ) Notice: Subject to any disclaimer, the term of this patent is extended or adjusted under 35 U.S.C. 154(b) by 0 days.

(21) Appl. No.: 16/670,787

(22) Filed: Oct. 31, 2019

(51) Int. Cl.
*A44B 11/25* (2006.01)

(52) U.S. Cl.
CPC ..... *A44B 11/2519* (2013.01); *A44B 11/2573* (2013.01)

(58) Field of Classification Search
CPC ..... A44B 11/2519; A44B 11/2573; Y10T 24/45094; Y10T 24/45084; Y10T 24/32
See application file for complete search history.

(56) References Cited

U.S. PATENT DOCUMENTS 7,152,282 B2 * 12/2006 Costa ..... A44C 5/20 24/303
2006/0174455 A1 * 8/2006 Saitoh ..... E05B 47/0038 24/303

* cited by examiner

*Primary Examiner* — Robert Sandy
(74) *Attorney, Agent, or Firm* — Tsz Lung Yeung

(57) ABSTRACT

A buckle assembly includes a first buckle member having an insertion member, a second buckle member having a receiving slot, and a locking arrangement. The locking arrangement includes a locking slot indently formed on the insertion member, a locking member movably mounted in the second buckle member at a position corresponding to the locking slot, and a releasing key detachably attached on the second buckle member to drive the locking member to move between a locked position and a releasing position. In the locked position, the locking member is moved to engage with the locking slot to prevent the insertion member from detaching from the receiving slot. In the releasing position, the locking member is driven by the releasing key to retract from the locking slot so as to allow the insertion member to be pulled out of the receiving slot.

20 Claims, 6 Drawing Sheets

BUCKLE ASSEMBLY WITH LOCKING ARRANGEMENT

BACKGROUND OF THE PRESENT INVENTION

Field of Invention

The present invention relates to buckle, and more particularly to a buckle assembly which comprises a locking arrangement which is capable of providing enhanced locking performance and convenient operation of the buckle assembly.

Description of Related Arts

A conventional buckle assembly, such as a buckle assembly for use with a strap, usually comprises a first buckle member and a second buckle member which may be detachably engaged with the first buckle member. The first buckle member may have an insertion member while the second buckle member may comprise a plurality of buckle latches and have a receiving slot formed at a position corresponding to the insertion member of the first buckle member. The receiving slot is shaped and sized to receive the insertion member so as to connect the first buckle member to the second buckle member. The buckle latches may be pivotally moved on the second buckle member to lock up the insertion member in the receiving slot.

A major disadvantage of conventional buckle assemblies such as the one described above is that the engagement between the first buckle member and the second buckle member is far from secure. The insertion member is usually locked and retained in the second buckle member by the buckle latches. The buckle latches are pivotally moved with respect to the second buckle member. When a user wishes to disengage the first buckle member from the second buckle member, he simply needs to pivotally move the buckle latches and pull the insertion member out from the receiving slot. That means anybody (including someone who does not wear the buckle assembly) can simply move the buckle latches and disengage the first buckle member from the second buckle member. This can cause undesirable result because the first buckle member and the second buckle member may be disengaged from each other too easily due to accidents or intentional actions from other parties. For example, a buckle assembly worn by a law enforcement officer may be easily disengaged by others at an attempt to neutralize his law enforcement equipment attached on his body by the buckle assembly.

As a result, there is a need to develop a buckle assembly which is secure enough so that first buckle member and the second buckle member may not be disengaged without proper authorization.

SUMMARY OF THE PRESENT INVENTION

Certain variations of the present invention provide a buckle assembly which comprises a locking arrangement which is capable of providing an enhanced locking performance and convenient operation of the buckle assembly.

Certain variations of the present invention provide a buckle assembly which comprises a locking arrangement comprising a specifically designed releasing key, wherein a user can only be able to detach a first buckle member from the second buckle member by using the releasing key. As such, an authorized user who does not have access to the releasing key will not be able to detach the buckle assembly from a wearer's person in a short period of time.

Certain variations of the present invention provide a buckle assembly which comprises a locking arrangement comprising a specifically designed releasing key, wherein the releasing key may be configured to fit only one series of corresponding buckle members.

In one aspect of the present invention, it provides a buckle assembly, comprising:

a first buckle member which comprises a first buckle body comprising an insertion member;

a second buckle member which comprises a second buckle body having a receiving slot formed at a position corresponding to the inserting member of the first buckle body, the receiving slot being shaped and sized to receive at least the insertion member, the insertion member being detachably inserted in the receiving slot for detachably engaging the second buckle member with the first buckle member; and a locking arrangement, which comprises:

a locking slot indently formed on the insertion member;

a locking member movably mounted in the second buckle member at a position corresponding to the locking slot when the insertion member is fittedly inserted in the receiving slot;

a releasing key detachably attached on the second buckle member to drive the locking member to move between a locked position and a releasing position, wherein in the locked position, the locking member is moved to engage with the locking slot to prevent the insertion member from detaching from the receiving slot, wherein in the releasing position, the locking member is driven by the releasing key to retract from the locking slot so as to allow the insertion member to be pulled out of the receiving slot for disengaging the first buckle member from the second buckle member; and a resilient element provided in the second buckle member to normally retain the locking member in the locked position.

This summary presented above is provided merely to introduce certain concepts and not to identify any key or essential features of the claimed subject matter.

DETAILED DESCRIPTION OF THE PREFERRED EMBODIMENT

Figure 1:
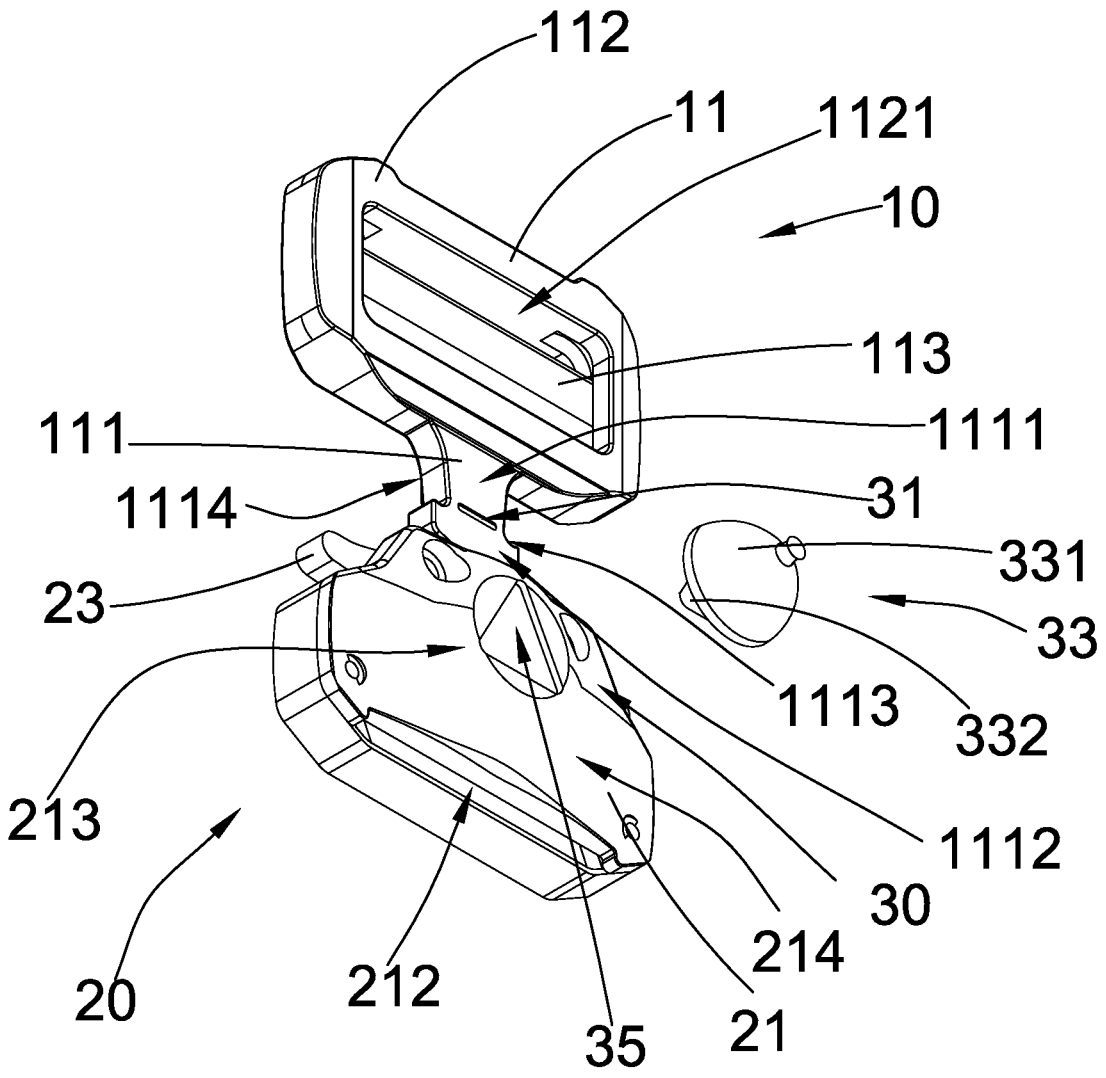
FIG. 1 is a perspective view of a buckle assembly according to a preferred embodiment of the present invention.
Figure 2:
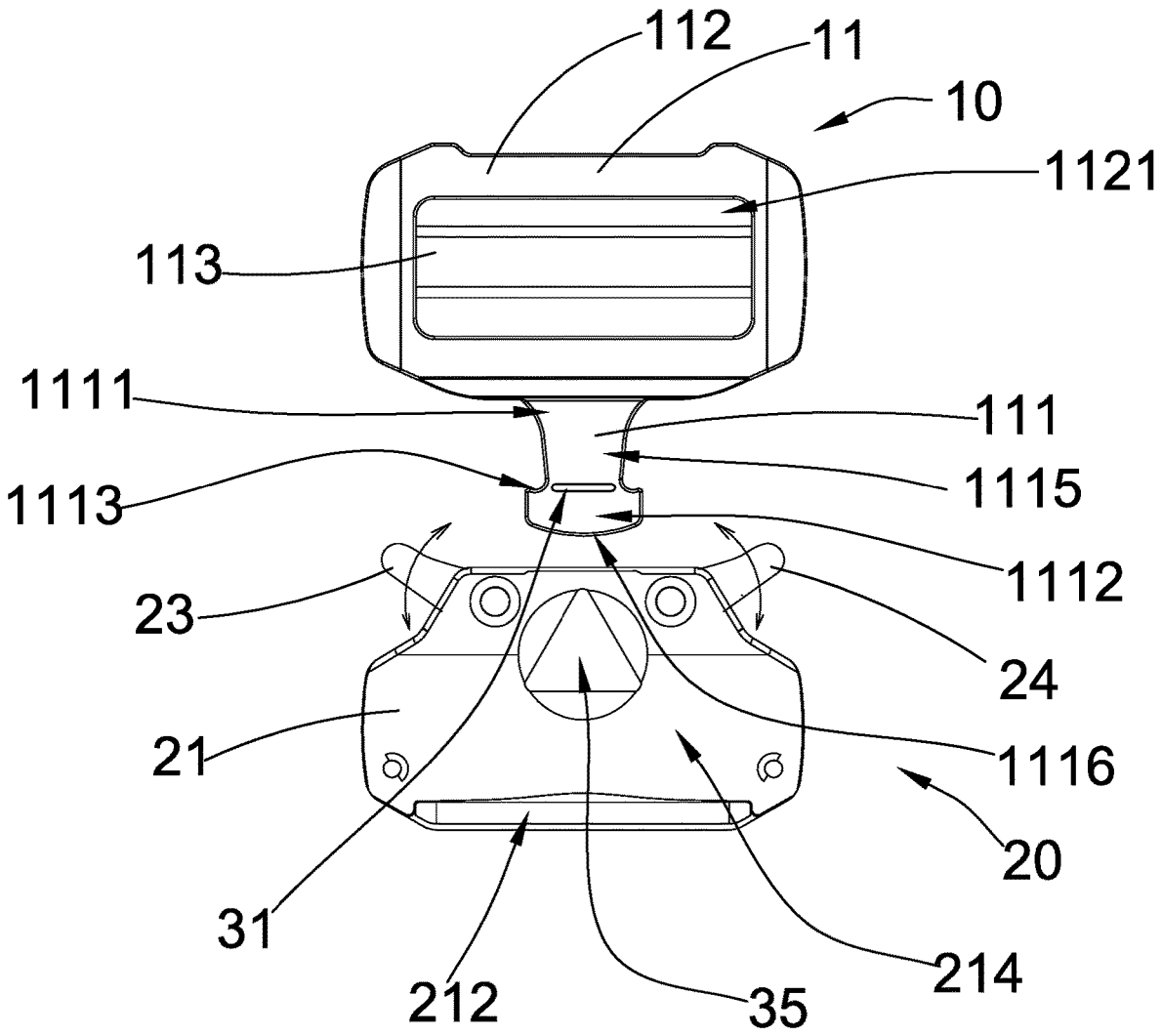
FIG. 2 is a front schematic diagram of the buckle assembly according to the preferred embodiment of the present invention.

The following detailed description of the preferred embodiment is the preferred mode of carrying out the invention. The description is not to be taken in any limiting sense. It is presented for the purpose of illustrating the general principles of the present invention.

Referring to FIG. 1 to FIG. 6 of the drawings, a buckle assembly according a preferred embodiment of the present invention is illustrated. Broadly, the buckle assembly may comprise a first buckle member 10, a second buckle member 20 detachably attached on the first buckle member 10, and a locking arrangement 30. The buckle assembly may be used in conjunction with a plurality of straps which may be worn on a user's body.

The first buckle member 10 may comprise a first buckle body 11 comprising an insertion member 111.

The second buckle member 20 may comprise a second buckle body 21 having a receiving slot 211 formed at a position corresponding to the inserting member 111 of the first buckle body 11. The receiving slot 211 may be shaped and sized to receive at least the insertion member 111. The insertion member 111 may be detachably inserted in the receiving slot 211 for detachably engaging the second buckle member 20 with the first buckle member 10.

The locking arrangement 30 may comprise a locking slot 31, a locking member 32, a releasing key 33 and a resilient element 34. The locking slot 31 may be indently formed on a front surface 1115 of the insertion member 111 of the first buckle body 11.

The locking member 32 may be movably mounted in the second buckle member 20 at a position corresponding to the locking slot 31 when the insertion member 111 is fittedly inserted in the receiving slot 211.

The releasing key 33 may be detachably attached on the second buckle member 20 to drive the locking member 32 to move between a locked position and a releasing position, wherein in the locked position, the locking member 32 may be moved to engage with the locking slot 31 to prevent the insertion member 111 from detaching from the receiving slot 211, wherein in the releasing position, the locking member 32 may be driven (such as magnetically attracted) by the releasing key 33 to retract from the locking slot 31 so as to allow the insertion member 111 to be pulled out from the receiving slot 211 for disengaging the first buckle member 10 from the second buckle member 20.

The resilient element 34 may be provided in the second buckle member 20 to normally retain the locking member 32 in the locked position.

According to the preferred embodiment of the present invention, the first buckle member 10 and the second buckle member 20 of the buckle assembly may be attached on two end portions of the strap so as to allow easy attachment and detachment of the two end portions. The first buckle body 11 may further comprise a connecting member 112 for connecting with a first end portion of the strap. The connecting member 112 may have a first connecting slot 1121 formed therein. The first buckle body 11 may further comprise a connecting shaft 113 extended across the first connecting slot 1121, so that the strap may be adjustably fastened to the first buckle body 11 through the first connecting slot 1121 and fasten on the connecting shaft 113.

The insertion member 111 may be intergally extended from the connecting member 112 for selectively receiving in the receiving slot 211. The insertion member 111 may have a contracting portion 1111 and an engaging portion 1112 extended from the contracting portion 1111 to form an engagement shoulder 1113 at an intersection between the contracting portion 1111 and the engaging portion 1112.

Figure 5:
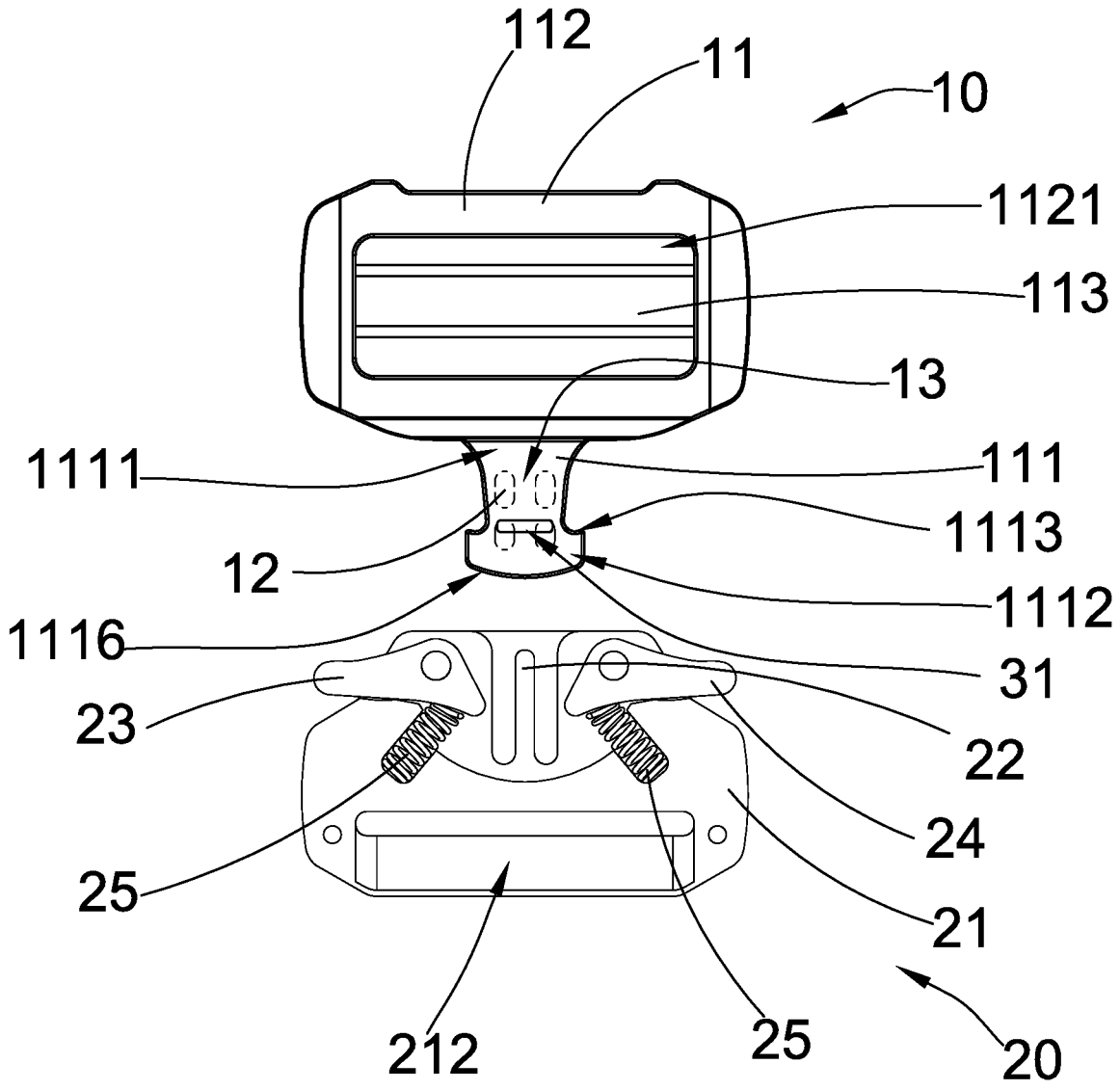
FIG. 5 is a schematic front view of the buckle assembly according to the preferred embodiment of the present invention.
Figure 6:
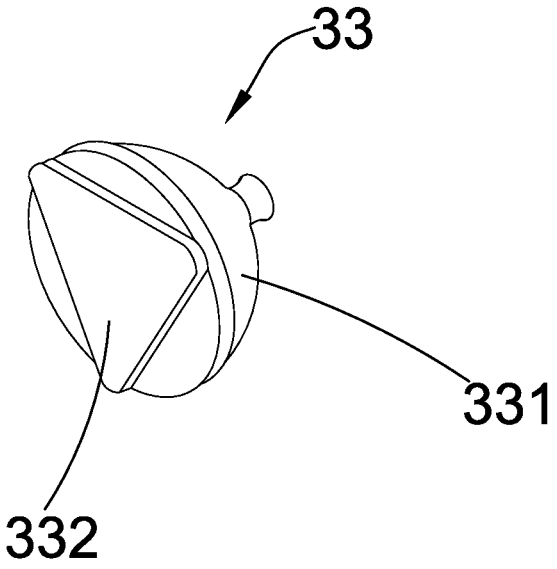
FIG. 6 is a perspective view of a releasing key of the buckle assembly according to the preferred embodiment of the present invention.

The first buckle member 10 may further comprise a plurality of protrusions 12 speacedly formed on a rear surface 1114 of the insertion member 111. The protrusions 12 may be distributed on the rear surface 1114 of the insertion member 111 to form a locking channel 13 between two opposing protrusions 12. As shown in FIG. 5 of the drawings, the first buckle member 10 may comprise four protrusions 12 which may be arranged in an array or a matrix having two rows and two columns. A locking channel 13 may be formed as a space between two columns of the protrusions 12. The protrusions 12 and the locking slot 31 may be formed on two opposite surfaces (rear surface 1114 and front surface 1115) respectively.

On the other hand, the second buckle member 20 may further comprise a guiding member 22 extended from the second buckle body 21, and may be arranged to be inserted in the locking channel 13 formed by the protrusions 12 so as to secure the first buckle member 10 with respect to the second buckle member 20 when the insertion member 11 is inserted in the receiving slot 211. The second buckle body 21 may have a through second connecting slot 212 formed thereon for allowing another end portion of the strap to pass through.

The second buckle member 20 may further comprises a first buckle latch 23 and a second buckle latch 24 pivotally connected to the second buckle body 21 in the receiving slot 211. The first buckle latch 23 and the second buckle latch 24 may be pivotally moved to engage with the engagement shoulder 1113 of the insertion member 111 when the insertion member 111 is securely received in the receiving slot 211. The first buckle latch 23 and the second buckle latch 24 may then lock the insertion member 111 in the receiving slot 211 until the first buckle latch 23 and the second buckle latch 24 are pivotally moved to disengage from the insertion member 111.

The second buckle member 20 may further comprise a plurality of elastic members 25 mounted in the second buckle body 21 for normally exerting a biasing force toward the first buckle latch 23 and the second buckle latch 24 respectively for retaining the first buckle latch 23 and the second buckle latch 24 to engage with the insertion member 111 when it is inserted in the receiving slot 211. Specifically, the elastic members 25 of the second buckle member 20 may be arranged to bias against one end (unexposed end) of the first buckle latch 23 and the second buckle latch 24 respectively for normally retaining the first buckle latch 23 and the second buckle latch 24 to engage with the insertion member 111 when it is inserted in the receiving slot 211.

The locking member 32 of the locking arrangement 30 may be movably mounted in the second buckle body 21 for selectively engaging with the locking slot 31 formed on the insertion member 111. The locking member 32 may have a predetermined magnetic property so that the locking member 32 may be magnetically attracted by another magnetic element such as a magnet. As examples, the locking member 32 may be configured as magnet having a predetermined polarity or made from iron. Moreover, the locking member 32 may be sized and shaped to fittedly engage with the locking slot 31 so as to prevent the insertion member 111 from being pulled out from the second buckle body 21. Thus, the locking member 32 may be driven to move along a transverse direction with respect to the first buckle body 11 and the second buckle body 21.

The locking arrangement 30 may further contain an engagement indention 35 indently formed on the second buckle body 21, wherein the releasing key 33 may be fittedly accommodated in the engagement indention 35 for magnetically attracting the locking member 32. As shown in FIG. 1 of the drawings, the second buckle body 21 may further have a supporting platform 213 protruded from a front surface 214 of the second buckle body 21, wherein the engagement indention 35 may be formed on the supporting platform 213.

The releasing key 33 may comprise a handle 331 and a magnetic engagement member 332 extended from the handle 331. The magnetic engagement member 332 may have a predetermined magnetic property which may magnetically attract the locking member 32 when the releasing key 33 is attached on the second buckle body 21. On the other hand, the engagement indention 35 may have a predetermined cross-sectional shape when viewed from the front, and this cross-sectional shape may correspond to a cross-sectional shape of the magnetic engagement member 332 so that the magnetic engagement member 332 may be fittedly engaged in the engagement indention 35 for magnetically attracting the locking member 32. For example, each of the magnetic engagement member 332 and the engagement indention 35 may have a triangular cross-sectional shape. This feature allows the manufacturer of the present invention to manufacture different cross-sectional shapes for the engagement indentions 35 and the magnetic engagement members 332 for different batches of buckle assemblies.

The magnetic force of the locking member 32 and the magnetic engagement member 332 may be configured or pre-set such that the magnetic engagement member 332 and the locking member 32 may only be magnetically attracting to each other when the magnetic engagement member 332 is fittedly engaged in the engagement indention 35.

Figure 3:
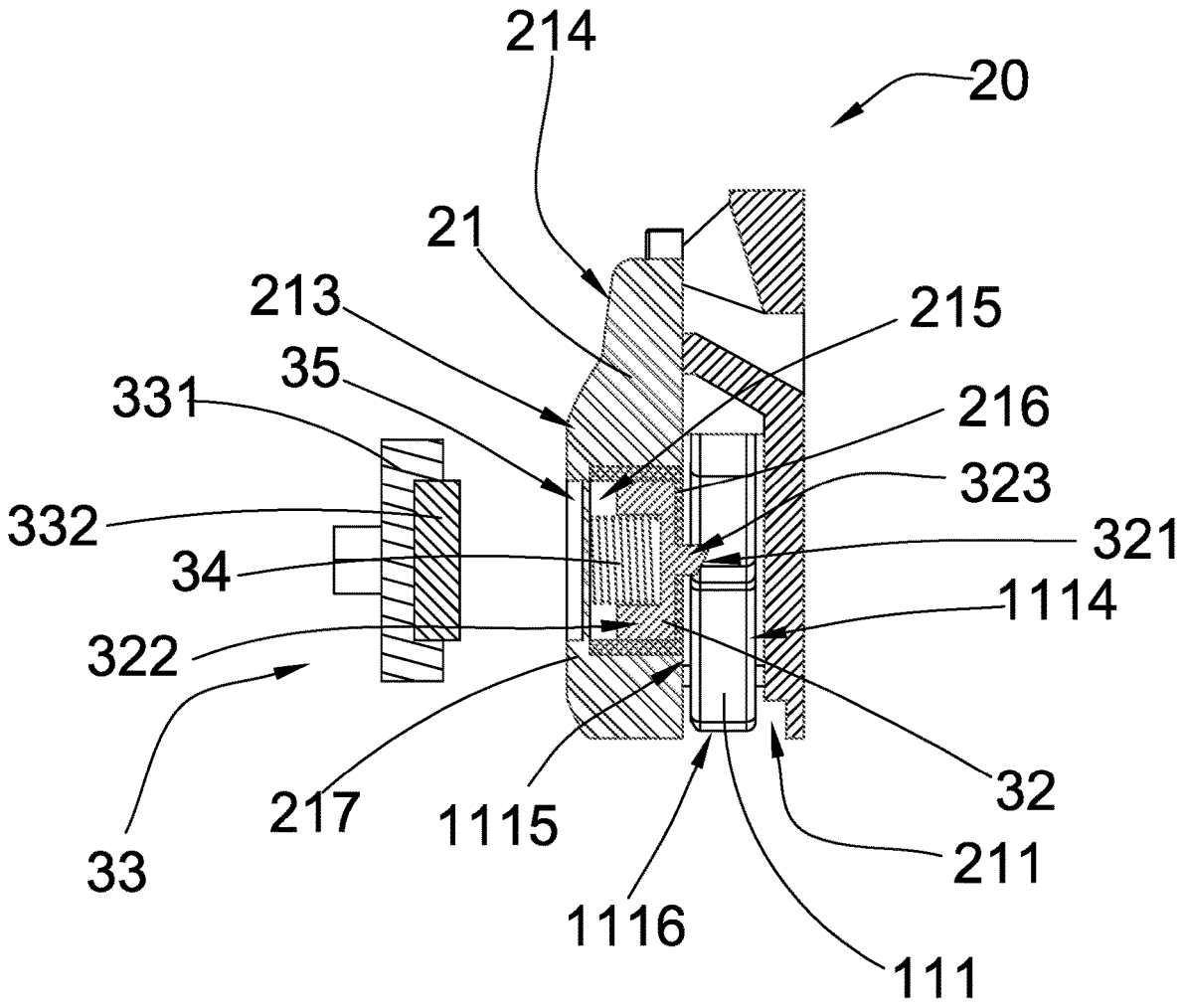
FIG. 3 is a sectional view of a second buckle body of the buckle assembly according to the preferred embodiment of the present invention, illustrating the locking member is in the locked position.
Figure 4:
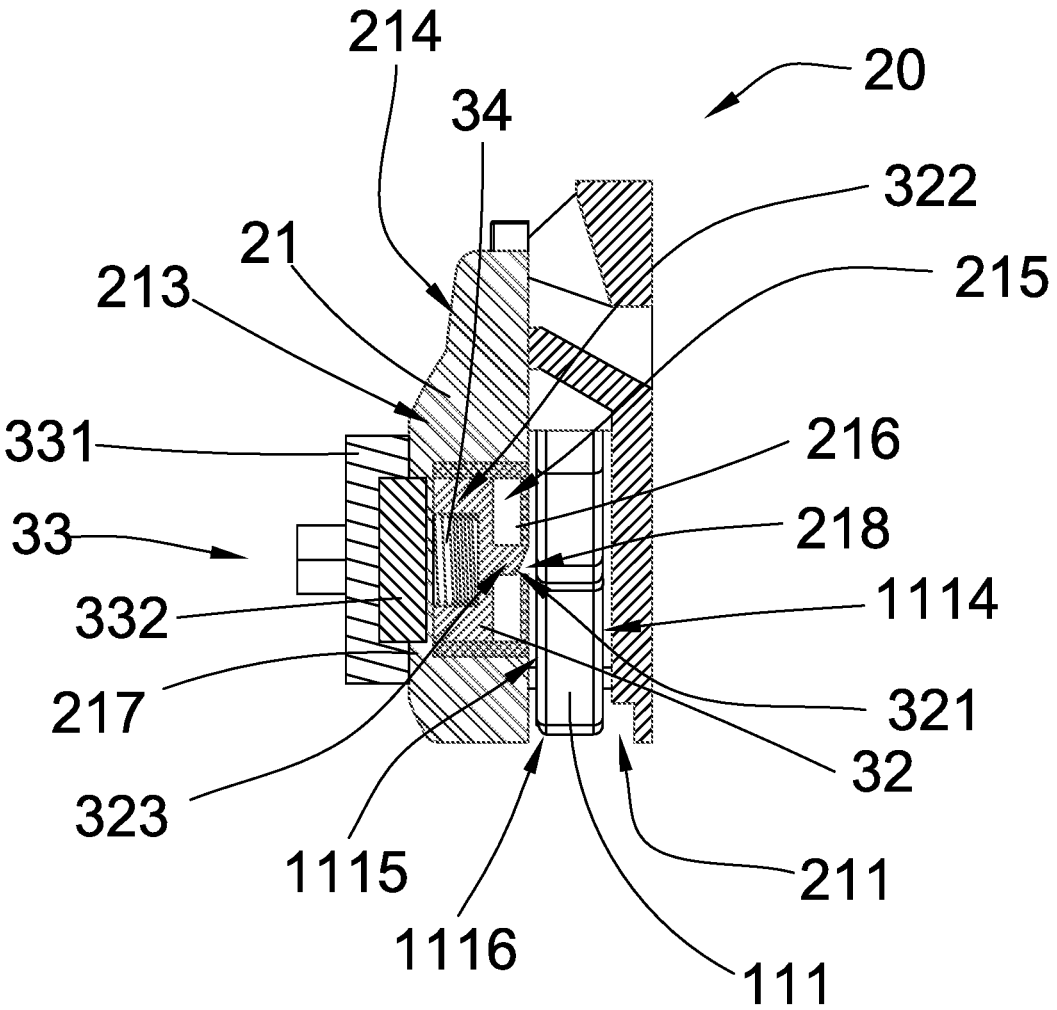
FIG. 4 is a sectional view of a second buckle body of the buckle assembly according to the preferred embodiment of the present invention, illustrating the locking member is in the releasing position.

According to the preferred embodiment of the present invention, and as shown in FIG. 3 and FIG. 4 of the drawings, the magnetic engagement member 332 and the locking member 32 may be positioned to rest on a same transverse axis with respect to the second buckle body 21 so as to maximize the magnetic attractive force between the magnetic engagement member 332 and the locking member 32.

In addition, the locking member 32 may further have a slanted surface 321 formed thereon for allowing the locking member 32 to be temporarily depressed when the insertion member 111 is being pushed to receive in the receiving slot 211. The slanted surface 321 may be arranged to face toward the opening of the receiving slot 211 so that when the insertion member 111 is being pushed into the receiving slot 211, a free end 1116 of the insertion member 111 may bias against the slanted surface 321 of the locking member 32 and further pushing thereof may eventually push the locking member 32 toward the front side of the second buckle body 21. When the biasing force from the insertion member 111 is greater than the urging force exerted by the resilient element 34 on the locking member 32, the locking member 32 may be forced to depress the resilient element 34 and temporarily retracted from the receiving slot 211 for allowing the insertion member 111 to be inserted in there until the locking slot 31 aligns with the locking member 32. At that time, the resilient element 34 may push the locking member 32 back to the receiving slot 211 to engage with the locking slot 31.

Thus, as shown in FIG. 3 and FIG. 4 of the drawings, the second buckle body 21 may further have an inner wall 216 defining a storage compartment 215 as a space surrounded by the inner wall 216 and the corresponding surrounding sidewall 217 of the second buckle body 21, wherein the resilient element 34 may be mounted in the storage compartment 215. On the other hand, the locking member 32 may have a depressing portion 322 received in the storage compartment 215, and a locking portion 323 extended from the depressing portion 322 to penetrate through the inner wall 216 and to selectively engage with the locking slot 31 via an opening 218. The slanted surface 321 may be formed on the locking portion 322 of the locking member 32. The resilient element 34 may be mounted in the storage compartment 215 to exert a biasing force against the depressing portion 321 towards the receiving slot 211. Note that the extent to which the locking portion 322 may be pushed into the receiving slot 211 may be eventually restricted by the inner wall 216.

The operation of the present invention is as follows: the first buckle member 10 and the second buckle member 20 may be detached, and the locking member 32 may be pushed by the resilient element 34 so that the locking portion 322 may be positioned and retained in the receiving slot 211. When a user tries to engage the first buckle member 10 with the second buckle member 20, the user may insert the insertion member 11 in the receiving slot 211 and the free end 1116 of the insertion member 11 may eventually push the slanted surface 321 of the locking member 32. Further pushing of the insertion member 11 may drive the locking member 32 to be depressed in the transverse direction with respect to the second buckle body 21. The depressing portion 322 may overcome the urging force exerted by the resilient element 34 and compress it. The locking portion 323 may be temporarily pushed toward the storage compartment 215 and allow the insertion member 11 to be further pushed into the receiving slot 211. When the locking portion 323 aligns with the locking slot 31, the urging force may push the locking portion 323 back to the locking slot 31 because the space formed by the locking slot 31 decreases the compression force exerted on the resilient element 34 which pushes the locking portion 323 back to the receiving slot 211 until the locking portion 323 engages in the locking slot 31. At this time, the insertion member 11 may also have engaged with the first buckle latch 23 and the second buckle latch 24 and the guiding member 22 may have engaged in the locking channel 13. The first buckle member 10 and the second buckle member 20 are therefore secured with respect to each other.

Without the releasing key 33, the first buckle member 10 cannot disengage from the second buckle member 10 even though the first buckle latch 23 and the second buckle latch 24 are disengaged from the insertion member 11. This is because the locking member 32 is engaged in the locking slot 31.

When a user attaches the releasing key 33 on the engagement indention 35, the magnetic engagement member 332 and the depressing portion 322 of the locking member 32 may magnetically attracting to each other. The locking portion 323 of the locking member 32 may then retract from the receiving slot 211 and disengage from the locking slot 31. At this moment, a user may be able to pivotally move the first buckle latch 23 and the second buckle latch 24 and disengage pull the second buckle member 20 from the first buckle member 10.

From the forgoing descriptions, it can be appreciated that the buckle assembly described above must need the releasing key 33 to disengage the second buckle member 20 from the first buckle member 10. Thus, when the releasing key 33 is properly secured, the engagement between the first buckle member 10 and the second buckle member 20 may be sufficiently ensured and the user wearing the buckle assembly of the present invention may get assured that accidental or intentional disengagement of the second buckle assembly 20 from the first buckle assembly 10 may be avoided as long as the releasing key 33 is absent.

Throughout the above descriptions, the locking member 32 may be driven by the releasing key 33 through magnetic force. However, one skilled in the art should bear in mind that the locking member 32 may be driven or actuated by other mechanical means to move between the locked position and the releasing position. These alternatives should be within the scope of the present invention.

The present invention, while illustrated and described in terms of a preferred embodiment and several alternatives, is not limited to the particular description contained in this specification. Additional alternative or equivalent components could also be used to practice the present invention.

What is claimed is:

1. A buckle assembly, comprising:

a first buckle member which comprises a first buckle body comprising an insertion member;

a second buckle member which comprises a second buckle body having a receiving slot formed at a position corresponding to said insertion member of said first buckle body, said receiving slot being shaped and sized to receive at least said insertion member, said insertion member being detachably inserted in said receiving slot for detachably engaging said second buckle member with said first buckle member; and a locking arrangement, which comprises:

a locking slot indently formed on said insertion member;

a locking member movably mounted in said second buckle member at a position corresponding to said locking slot when said insertion member is fittedly inserted in said receiving slot;

a releasing key detachably attached on said second buckle member to drive said locking member to move between a locked position and a releasing position, wherein in said locked position, said locking member is moved to engage with said locking slot to prevent said insertion member from detaching from said receiving slot, wherein in said releasing position, said locking member is driven by said releasing key to retract from said locking slot so as to allow said insertion member to be pulled out of said receiving slot for disengaging said first buckle member from said second buckle member; and a resilient element provided in said second buckle member to normally retain said locking member in said locked position.

2. The buckle assembly, as recited in claim 1, wherein said locking member further has a slanted surface formed thereon for allowing said locking member to be temporarily depressed when said insertion member is being pushed to receive in said receiving slot, said slanted surface being arranged to face toward said opening of said receiving slot.

3. The buckle assembly, as recited in claim 2, wherein said second buckle body further has an inner wall defining a storage compartment as a space surrounded by said inner wall and a corresponding surrounding sidewall of said second buckle body, wherein said resilient element is mounted in said storage compartment, said locking member having a depressing portion received in said storage compartment, and a locking portion extended from said depressing portion to penetrate through said inner wall and to selectively engage with said locking slot via an opening formed on said inner wall, said resilient element being mounted in said storage compartment to exert a biasing force against said depressing portion towards said receiving slot.

4. The buckle assembly, as recited in claim 3, wherein said releasing key comprises a handle and a magnetic engagement member extended from said handle, said magnetic engagement member has a predetermined magnetic property which is arranged to magnetically attract said locking member when said releasing key is attached on said second buckle body.

5. The buckle assembly, as recited in claim 4, wherein said locking arrangement further contains an engagement indention indently formed on said second buckle body, wherein said releasing key is arranged to be fittedly accommodated in said engagement indention for magnetically attracting said locking member.

6. The buckle assembly, as recited in claim 4, wherein said locking member has a predetermined magnetic property so that said locking member is arranged to magnetically attract to said magnetic engagement member of said releasing key, said locking member being sized and shaped to fittedly engage with said locking slot so as to prevent said insertion member from being pulled out from said second buckle body when said locking member is in said locked position.

7. The buckle assembly, as recited in claim 5, wherein said engagement indention and said magnetic engagement member have an identical and a corresponding cross-sectional shape so that said magnetic engagement member is capable of being fittedly engaged in said engagement indention for magnetically attracting said locking member.

8. The buckle assembly, as recited in claim 7, wherein said second buckle body further has a supporting platform protruded from a front surface of said second buckle body, wherein said engagement indention is formed on said supporting platform.

9. The buckle assembly, as recited in claim 8, wherein said locking member has a predetermined magnetic property so that said locking member is arranged to magnetically attract to said magnetic engagement member of said releasing key, said locking member being sized and shaped to fittedly engage with said locking slot so as to prevent said insertion member from being pulled out from said second buckle body when said locking member is in said locked position.

10. The buckle assembly, as recited in claim 1, wherein said releasing key comprises a handle and a magnetic engagement member extended from said handle, said magnetic engagement member has a predetermined magnetic property which is arranged to magnetically attract said locking member when said releasing key is attached on said second buckle body.

11. The buckle assembly, as recited in claim 10, wherein said locking arrangement further contains an engagement indention indently formed on said second buckle body, wherein said releasing key is arranged to be fittedly accommodated in said engagement indention for magnetically attracting said locking member.

12. The buckle assembly, as recited in claim 11, wherein said engagement indention and said magnetic engagement member have an identical and a corresponding cross-sectional shape so that said magnetic engagement member is capable of being fittedly engaged in said engagement indention for magnetically attracting said locking member.

13. The buckle assembly, as recited in claim 12, wherein said second buckle body further has a supporting platform protruded from a front surface of said second buckle body, wherein said engagement indention is formed on said supporting platform.

14. The buckle assembly, as recited in claim 1, wherein said locking arrangement further contains an engagement indention indently formed on said second buckle body, wherein said releasing key is arranged to be fittedly accommodated in said engagement indention for magnetically attracting said locking member.

15. The buckle assembly, as recited in claim 14, wherein said engagement indention and said magnetic engagement member have an identical and a corresponding cross-sectional shape so that said magnetic engagement member is capable of being fittedly engaged in said engagement indention for magnetically attracting said locking member.

16. The buckle assembly, as recited in claim 15, wherein said second buckle body further has a supporting platform protruded from a front surface of said second buckle body, wherein said engagement indention is formed on said supporting platform.

17. The buckle assembly, as recited in claim 16, wherein said first buckle member further comprises a plurality of protrusions spacedly formed on a rear surface of said insertion member, said protrusions are distributed on said rear surface of said insertion member to form a locking channel between two opposing protrusions, said second buckle member further comprising a guiding member extended from said second buckle body, and is arranged to be inserted in said locking channel so as to secure said first buckle member with respect to said second buckle member when said insertion member is inserted in said receiving slot.

18. The buckle assembly, as recited in claim 1, wherein said locking member has a predetermined magnetic property so that said locking member is arranged to magnetically attract to said releasing key, said locking member being sized and shaped to fittedly engage with said locking slot so as to prevent said insertion member from being pulled out from said second buckle body when said locking member is in said locked position.

19. The buckle assembly, as recited in claim 18, wherein said first buckle member further comprises a plurality of protrusions spacedly formed on a rear surface of said insertion member, said protrusions are distributed on said rear surface of said insertion member to form a locking channel between two opposing protrusions, said second buckle member further comprising a guiding member extended from said second buckle body, and is arranged to be inserted in said locking channel so as to secure said first buckle member with respect to said second buckle member when said insertion member is inserted in said receiving slot.

20. The buckle assembly, as recited in claim 1, wherein said first buckle member further comprises a plurality of protrusions spacedly formed on a rear surface of said insertion member, said protrusions are distributed on said rear surface of said insertion member to form a locking channel between two opposing protrusions, said second buckle member further comprising a guiding member extended from said second buckle body, and is arranged to be inserted in said locking channel so as to secure said first buckle member with respect to said second buckle member when said insertion member is inserted in said receiving slot.

* * * * *